United States Patent [19]

Focke

[11] Patent Number: 4,938,005

[45] Date of Patent: Jul. 3, 1990

[54] PROCESS AND APPARATUS FOR THE PRODUCTION OF HINGE-LID PACKS HAVING A COLLAR, ESPECIALLY FOR CIGARETTES

[75] Inventor: Heinz Focke, Verden, Fed. Rep. of Germany

[73] Assignee: Focke & Co. (GmbH & Co.), Verden, Fed. Rep. of Germany

[21] Appl. No.: 295,324

[22] Filed: Jan. 10, 1989

[30] Foreign Application Priority Data

Jan. 13, 1988 [DE] Fed. Rep. of Germany ..... 3800664

[51] Int. Cl.[5] ..... B65B 19/20

[52] U.S. Cl. ..... 53/410; 53/202; 53/389; 493/911

[58] Field of Search ..... 53/410, 415, 389, 202, 53/209, 203; 493/911, 910

[56] References Cited

U.S. PATENT DOCUMENTS

| | | | |
|---|---|---|---|
| 4,084,393 | 4/1978 | Focke | 493/911 X |
| 4,258,528 | 3/1981 | Focke | 53/202 X |
| 4,308,708 | 1/1982 | Focke | 53/202 X |
| 4,617,780 | 10/1986 | Focke et al. | 53/202 X |

FOREIGN PATENT DOCUMENTS

| | | | |
|---|---|---|---|
| 0082348 | 4/1984 | European Pat. Off. . | |
| 2447917 | 7/1975 | Fed. Rep. of Germany | 493/911 |
| 3150447 | 6/1983 | Fed. Rep. of Germany . | |

*Primary Examiner*—James F. Coan

*Attorney, Agent, or Firm*—Sughrue, Mion, Zinn, MacPeak & Seas

[57] ABSTRACT

Hinge-lid packs, especially for cigarettes, are equipped with a collar which extends in the region of the front wall and side walls of a pack part of the hinge-lid pack and which projects from this. The collar is formed from a collar blank severed from a material web of thin cardboard, specifically by being laid onto the pack content, especially a cigarette block. On high-performance packaging machines, the hinge-lid packs are produced in two production tracks running next to one another. Two collar blanks (10, 11, 12) therefore have to be fed simultaneously to the cigarette blocks (15, 16) to be packaged simultaneously. For reasons of space, the collar blanks (10, etc.) are severed from a single material web (13), then grouped next to one another in pairs and finally transported into the region of a transfer station (14) by means of a transversely directed feed conveyor (41). The essentially Z-shaped paths of movement of the collar blanks (10, 11, 12) allow an efficient, accurate and faultless conveyance of the collar blanks up to the transfer to the pack content.

14 Claims, 6 Drawing Sheets

PROCESS AND APPARATUS FOR THE PRODUCTION OF HINGE-LID PACKS HAVING A COLLAR, ESPECIALLY FOR CIGARETTES

BACKGROUND OF THE INVENTION

The invention relates to a process for the production of hinge-lid packs having a collar, especially for cigarettes, collar blanks being severed from a material web and being laid individually onto a cigarette block (cigarette group wrapped in an inner blank) to be introduced into the hinge-lid pack. The invention further relates to an apparatus for the production of hinge-lid packs of this type.

Hinge-lid packs are a very common type of pack for cigarettes. The pack content is a cigarette block, that is to say a cigarette group wrapped in an inner blank consisting especially of tin foil. The hinge-lid pack consists of a pack part and of a hinge lid attached pivotably to a rear wall of the latter. In the pack part there is a collar which partially projects from this and extends in the region of a front wall and in the region of side walls of the pack part and which, when the hinge-lid pack is in the closed position, is partially surrounded by the lid.

SUMMARY OF THE INVENTION

The invention is concerned with the production and processing of the collars within a packaging machine. For this, the procedure is such that collar blanks are severed successively from a material web of appropriate width, consisting especially of thin cardboard, and fed to the hinge-lid packs. The appropriate procedure for combining the collar blanks with the hinge-lid packs involves laying each of the collar blanks onto a cigarette block and introducing it, together with this, into the partially finished hinge-lid pack. EP-A-82,348 shows an example of the feed of a collar blank to a cigarette block and of the transfer of this unit to a partially folded hinge-lid pack.

The object on which the invention is based is to increase the productive capacity of the packaging machine with regard to the provision of the collars or collar blanks, without thereby appreciably increasing the outlay in mechanical and production terms.

To achieve this object, the process according to the invention is characterized in that, with two hinge-lid packs at a time being produced simultaneously in two production tracks extending next to one another, the two collar blanks, each fed simultaneously to a cigarette block are severed successively from a single common material web, the first of these two collar blanks is then moved as a result of a transverse shift into a position next to the other collar blank to be processed simultaneously, and thereafter the two collar blanks lying next to one another are fed to the associated cigarette blocks of the two production tracks.

The process according to the invention therefore starts from a packaging machine or a packaging process, in which the hinge-lid packs are produced in a dual-track manner, that is to say in pairs. Nevertheless, to achieve the best possible utilization of space, but also to simplify the apparatus, only one material web is used for the collar blanks. The material web is drawn off from a reel. Individual collar blanks are then severed successively from the material web and conveyed along a blank track into an intermediate station. In this, the successively arriving collar blanks are halted briefly, and of the two collar blanks to be fed jointly to two cigarette blocks, that arriving first in the intermediate station is shifted sideways in such a way that, together with the following collar blank, a pair of collar blanks is provided in the intermediate station in line next to one another.

The two collar blanks lying next to one another are then transported further in the original direction of movement, namely the conveying direction to the blank track, into the region of a transverse feed track. The collar blanks are now conveyed intermittently into a transfer station in the transverse direction and here are transferred respectively in pairs to two cigarette blocks on pack tracks running next to one another. The collar blanks therefore execute approximately a Z-shaped movement, every second collar blank being brought into a sideways position in the intermediate station, so that two collar blanks lie next to one another.

The apparatus according to the invention consists of a blank conveyor for transporting the individual blanks preferably continuously at a distance from one another after they have been severed from the material web, of a cross conveyor arranged in the region of the intermediate station and for the transverse movement of every second collar blank, and of a feed conveyor for the intermittent transverse movement of blanks aligned next to one another as far as the transfer station.

According to a proposal of the invention, the cross conveyor and the feed conveyor are designed as belt conveyors, especially toothed belts, with drivers located on the outer face of a conveying strand. The drivers are arranged at selected distances from one another, at the same time being coordinated with the conveying speed, so that the exact positioning of the collar blanks in the region of the transfer station is thereby guaranteed. The end positions of the collar blanks in the intermediate station and in the transfer station are determined by stops, individual ones of which can be moved out of the path of movement of the collar blanks in order to allow other collar blanks to be transported past.

Further details of the invention relate to the design of the conveyors for the collar blanks, of stops and of the transfer station in the region of the pack tracks.

The process according to the invention and an exemplary embodiment of the apparatus are explained in detail below by means of the drawings. In these:

DETAILED DESCRIPTION OF A PREFERRED EMBODIMENT

Figure 1:
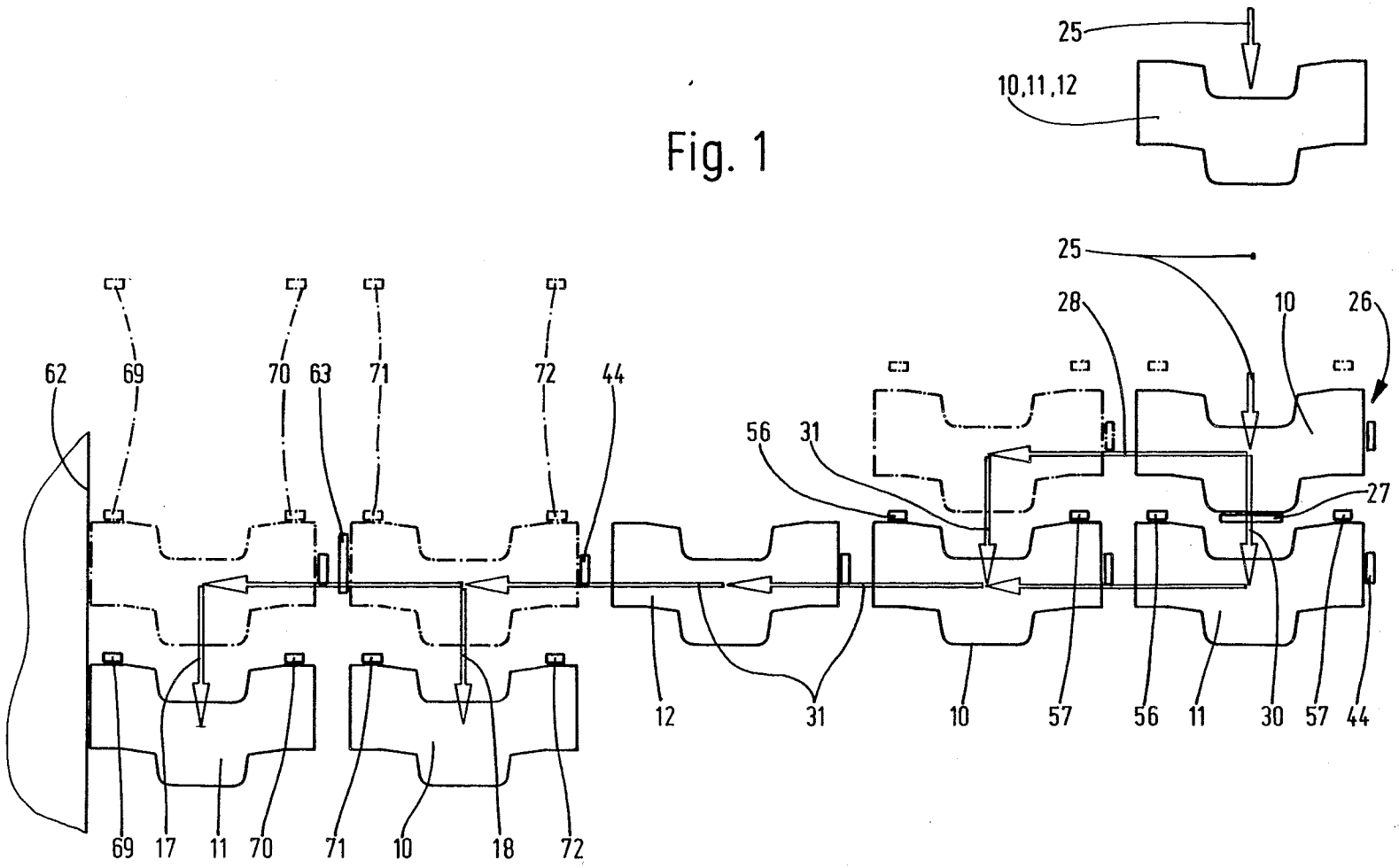
FIG. 1 shows a plan view of collar blanks during one phase of movement.

During the production of hinge-lid packs for cigarettes or the like, collars have to be introduced into the hinge-lid packs. These consist of a collar front wall and two collar side walls. In the drawings, collar blanks 10, 11, 12 not yet shaped into a collar are shown with the typical horizontal projection. The collar blanks 10, 11, 12 are severed successively from a continuous material web 13 (thin cardboard). During the further run, the collar blanks 10, 11, 12 are arranged relative to one another in such a way that, in the region of a transfer station 14, two collar blanks 10, 11 at a time are provided in line next to one another for transfer to two cigarette blocks 15, 16. To achieve a high output, the present packaging machine is of dual-track design. Accordingly, two hinge-lid packs are produced simultaneously on two production tracks running next to one another. Correspondingly, two cigarette blocks 15, 16 at a time are guided through the transfer station 14 in parallel and synchronously on block tracks 17 and 18 running next to one another.

It is now important to ensure an appropriate movement of the successively severed collar blanks 10, 11, 12, so that they assume the position aligned with the cigarette blocks 15, 16.

In the exemplary embodiment illustrated, the material web 13, being conveyed continously, is guided through a severing station 19. By means of a cutting unit consisting of a knife roller 20 and of a mating roller 21, the collar blanks 10, etc. are severed as a result of a transversely directed severing cut corresponding to the contour of the collar blanks 10, etc. The material web 13 has the width of the collar blanks 10, etc.

The individual collar blanks 10, etc. are subsequently transported by a blank conveyor 22 which is driven at a higher speed than the material web 13. As a result, a sufficient distance between the successive collar blanks 10, 11, 12 is provided. In the present exemplary embodiment (FIG. 5), the blank conveyor 22 consists of pairs of conveying rollers 23, 24.

The collar blanks 10, etc. are conveyed by the blank conveyor 22 on a rectilinear blank track 25 into an intermediate station 26. This is defined by a stop 27, against which a conveying part of the particular collar blank 10, etc. comes to rest.

Figure 2:
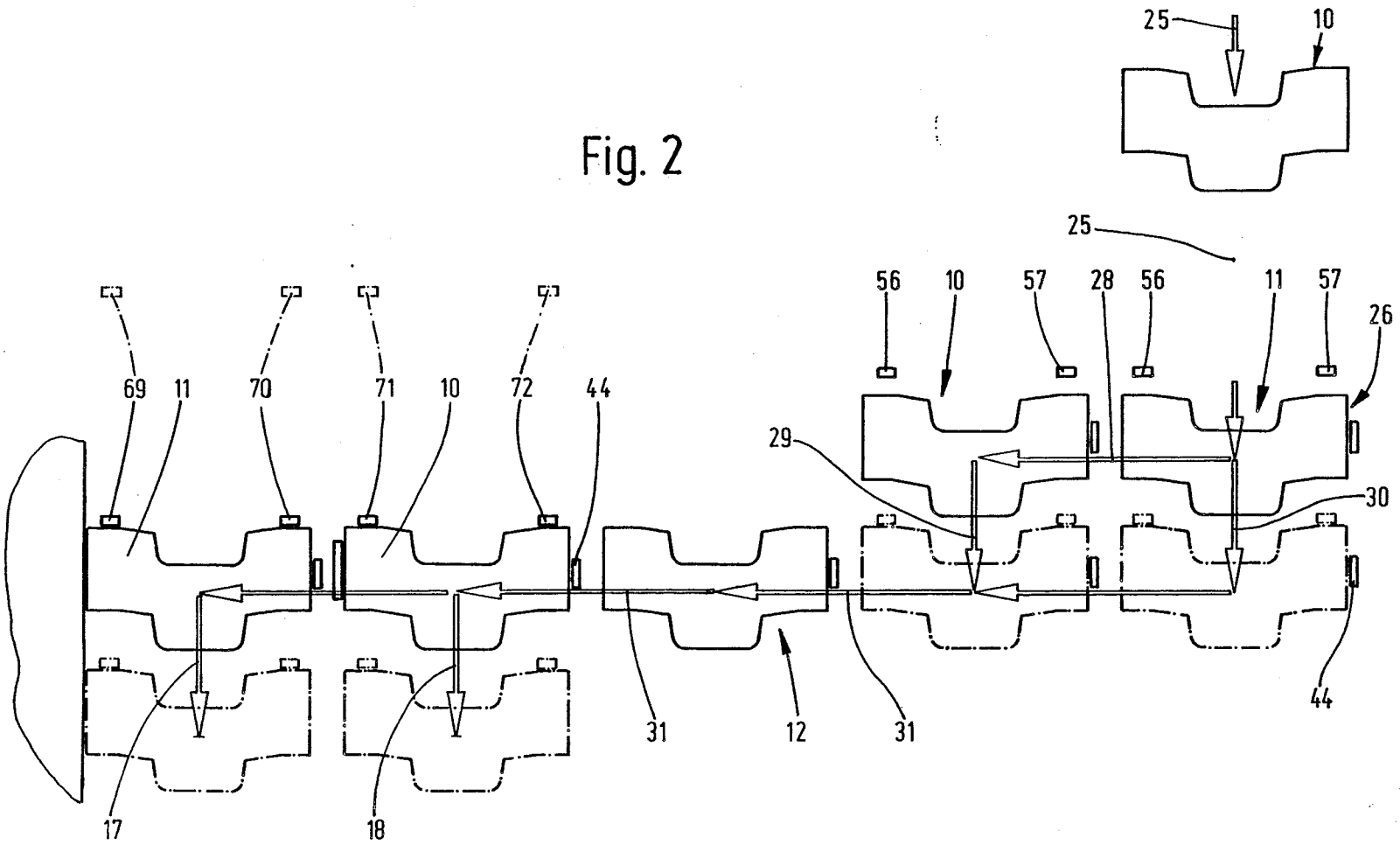
FIG. 2 shows a representation corresponding to that of FIG. 1 in another phase of movement.

In the intermediate station 26, two collar blanks 10, 11 are brought into a position next to one another. For this purpose, the first collar blank 10, after reaching the intermediate station 26 (up against the stop 27), is moved transversely into a sideways position according to the arrow 28 (FIG. 2). The following collar blank 11 remains in position because it is up against the stop 27. Thereafter, the two blanks 10 and 11 now lying next to one another are moved further simultaneously according to the arrows 29 and 30, that is to say in the direction of the blank track 25, specifically into a transversely directed feed track 31.

The collar blanks 10, 11, 12 are now fed intermittently to the transfer station 14 along the transversely directed feed track 31 without any variation in their relative position. The collar blanks 10, 11, 12 are moved, in the region of the feed track 31, by the amount of a stroke corresponding to two collar blanks 10, 11. However, the collar blanks 10, 11 are not moved directly into the transfer station 14 after reaching the feed track 31. Because of the availing conditions of space, three collar blanks 10, 11, 12 are moved further during each conveying stroke, the two collar blanks 10, 11 leading in the transport direction passing into the transfer station 14, whilst the collar blank 12 assumes an intermediate position.

The collar blank 10 is transported transversely in the region of the intermediate station 26 by means of a cross conveyor 32 which, in the present case, is designed as a toothed belt 33. This runs over a driving roller 34 and a deflecting roller 35. The latter is mounted on a transversely directed supporting arm 36 which is connected via a bearing sleeve 37 to a machine stand 38 of the packaging machine. The toothed belt 33 is located above the plane of movement of the collar blanks 10, 11, etc. The collar blank 10 is conveyed into the sideways position by means of a lower conveying strand 39. For this purpose, the toothed belt 33 is equipped with drivers 40 pointing outwards. These respectively grasp a collar blank 10 laterally.

The toothed belt 33 is driven intermittently. After the collar blank 10 arrives in the intermediate station 26, the toothed belt 33 is set in motion, one of the drivers 40 grasping the collar blank 10 and conveying it into the sideways position (FIG. 2).

In the region of the feed track 31, the collar blanks 10, 11, 12 are transported parallel to the cross conveyor 32 by means of a feed conveyor 41. Here, the feed conveyor 41 too is designed as a toothed belt 42 which runs above the path of movement of the collar blanks 10, 11, 12. A lower conveying strand 43 is equipped on the outer face with drivers 44 which respectively grasp a collar blank 10, 11, 12 laterally. The distances between the drivers 44 correspond to the distance between two collar blanks 10, 11 in the region of the transfer station 14. During each conveying stroke, the toothed belt 42 is driven by the amount of a travel (220 mm) corresponding to two collar blanks 10, 11.

The toothed belt 42 is likewise guided over a driving roller 45 and a deflecting roller 46. The latter is located at the end of a supporting arm 47 which is likewise connected to the machine stand 38.

The indexing stroke of the cross conveyor 32 is different from that of the feed conveyor 41. The drivers 40 of the toothed belt 33 are such a distance from one another that, at the start of a conveying stroke, an idle stroke of 70 mm is first executed. There is then a drive stroke, that is to say a transport stroke with a collar blank 10 being taken up, of 110 mm. When the toothed belt 33 is stationary, the next conveying driver 40 is located at a distance from the collar blank 10 provided in the intermediate station 26.

In the region of the intermediate station 26 and in the region of the feed conveyor 41, the collar blanks 10, 11, 12 rest on a plate-shaped supporting track 48. This is equipped on the top side with grooves 49 and 50, the former for the entry of the drivers 40 of the toothed belt 33 and the latter for the drivers 44 of the toothed belt 42. Outside the grooves 49, 50, the collar blanks 10, 11, 12 lie on the supporting track 48 and are thereby conveyed in a sliding manner.

Figure 6:
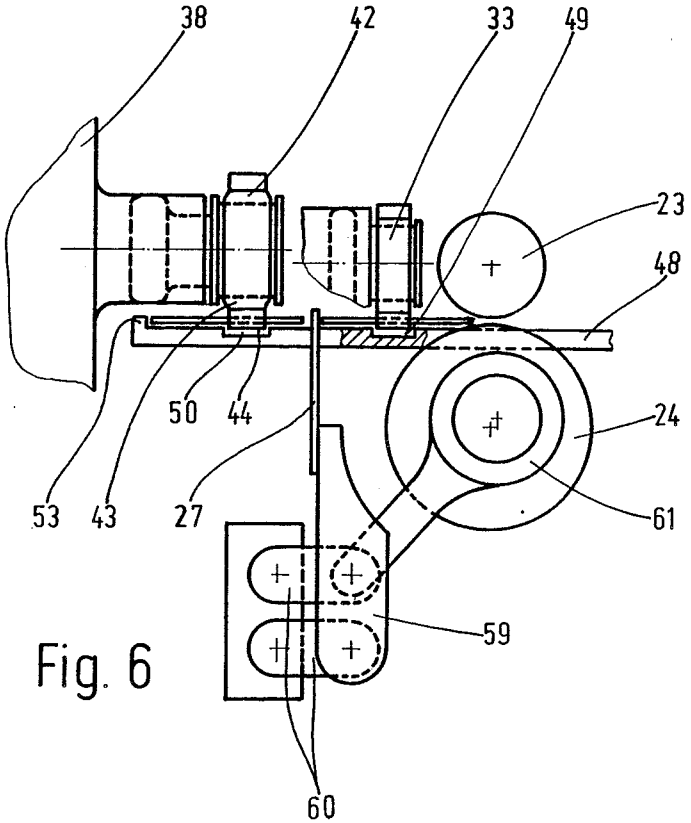
FIG. 6 shows a further detail of the apparatus in the region of the intermediate station in a view corresponding to that of FIG. 5.

In order to define the sideways position of the collar blank 10 (FIG. 2), the supporting track 48 has a stop wall 51 mounted on it. This merges into a lateral limitation 52 in the region of the feed track 31. On the opposite side, the supporting track 48 is equipped with a rim 53 (FIG. 6) as a guide for the collar blank 10, 11, 12.

For moving the collar blanks 10, 11 out of the intermediate station 26 into the region of the feed conveyor 41, a transfer conveyor 54 is provided. Here, this consists of a pivotable gathering arm 55 with hook-shaped driving fingers 56, 57 which are assigned respectively pairs to each of the collar blanks 10, 11. The driving fingers 56, 57 come to rest against the collar blank 10, 11 on the rear side at a distance from one another.

Figure 4:
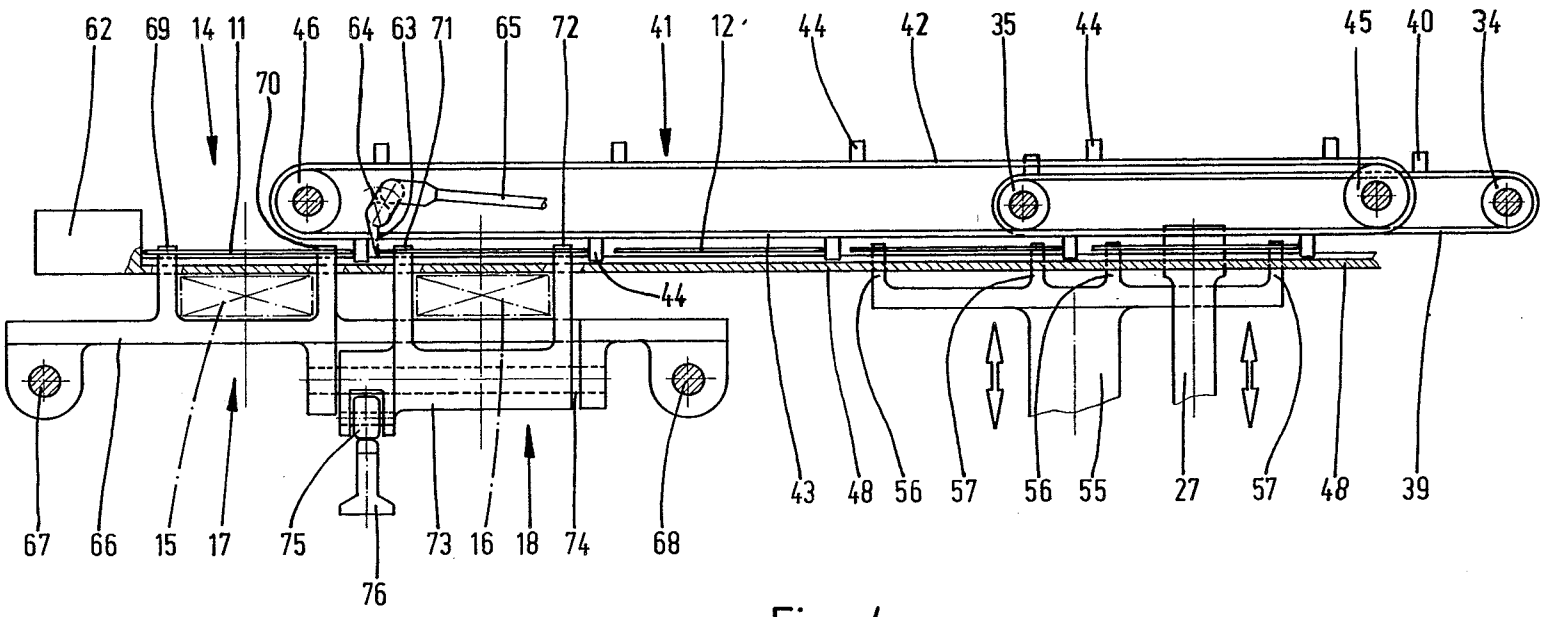
FIG. 4 shows a cross-section and end view of the details of the apparatus according to FIG. 3.
Figure 5:
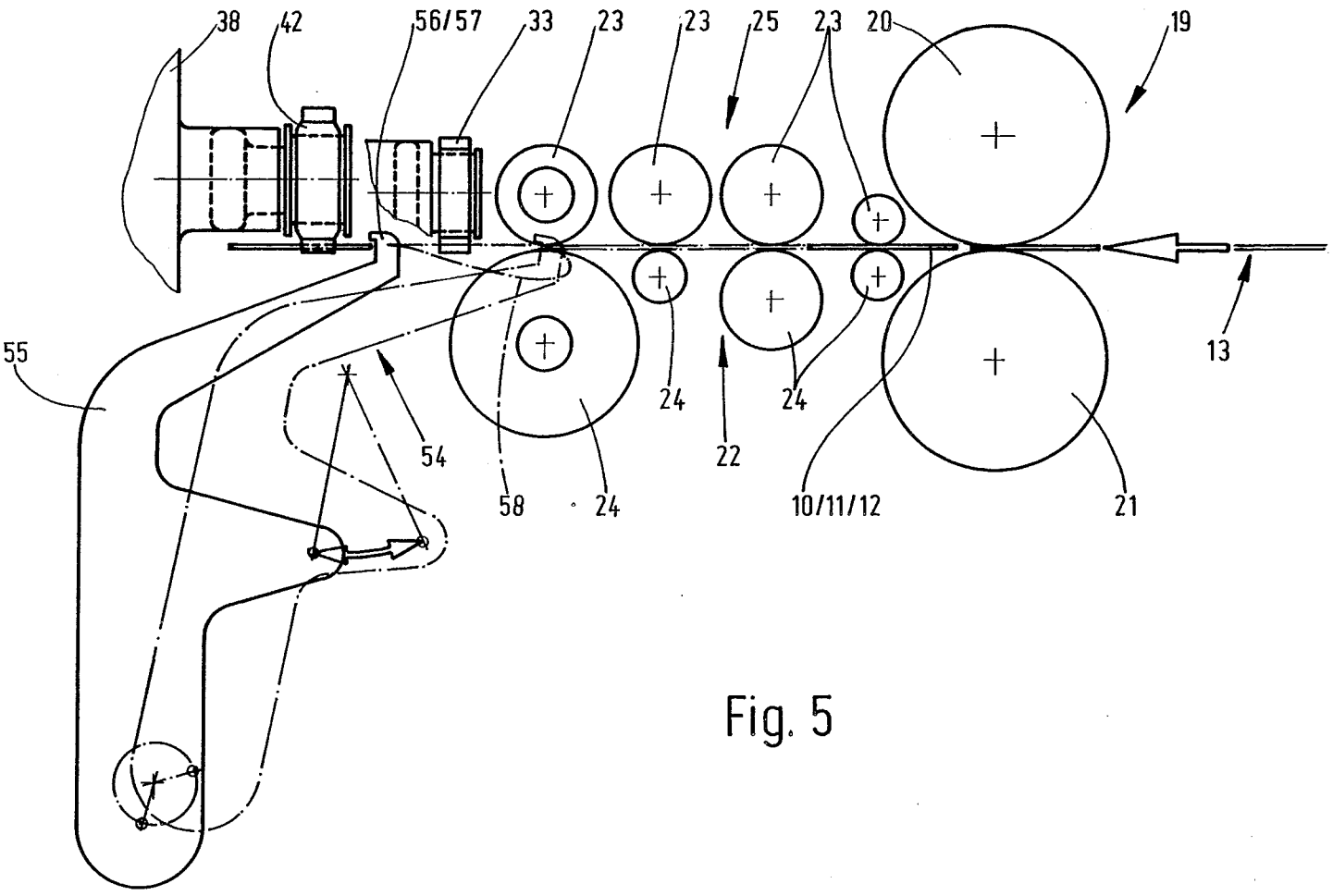
FIG. 5 shows, on an enlarged scale, a side view, offset 90° relative to FIG. 4, of the apparatus in the region of the intermediate station.

The gathering arm 55 and therefore the driving fingers 56, 57 are moved by means of a crank mechanism, in such a way that the driving fingers 56, 57 are brought out of the initial position shown in FIGS. 5 and 4, the two collar blanks 10, 11 at the same time being taken up, into the end position represented by unbroken lines. Thereafter, the driving fingers 56, 57 are taken downwards out of the path of movement of the collar blanks 10, 11 and guided back into the initial position underneath this along the curved path 58. An exact conveying stroke of the two collar blanks 10, 11 is defined by the path of movement of the driving fingers 56, 57.

During this transfer conveyance of the collar blanks 10, 11, the stop 27 has to be retracted out of the path of movement of the latter. According to FIG. 6, for this purpose the stop 27 is connected to parallel links 60 via a stop holder 59. The stop holder 59 is actuated by means of an eccentric mechanism 61 which is driven by a lower conveying roller 24 of the blank conveyor 22. The stop 27 thereby executes short tilt-free up-and-down movements, the stop 27 being in the lower position underneath the path of movement of the collar blanks 10, 11.

Figure 3:
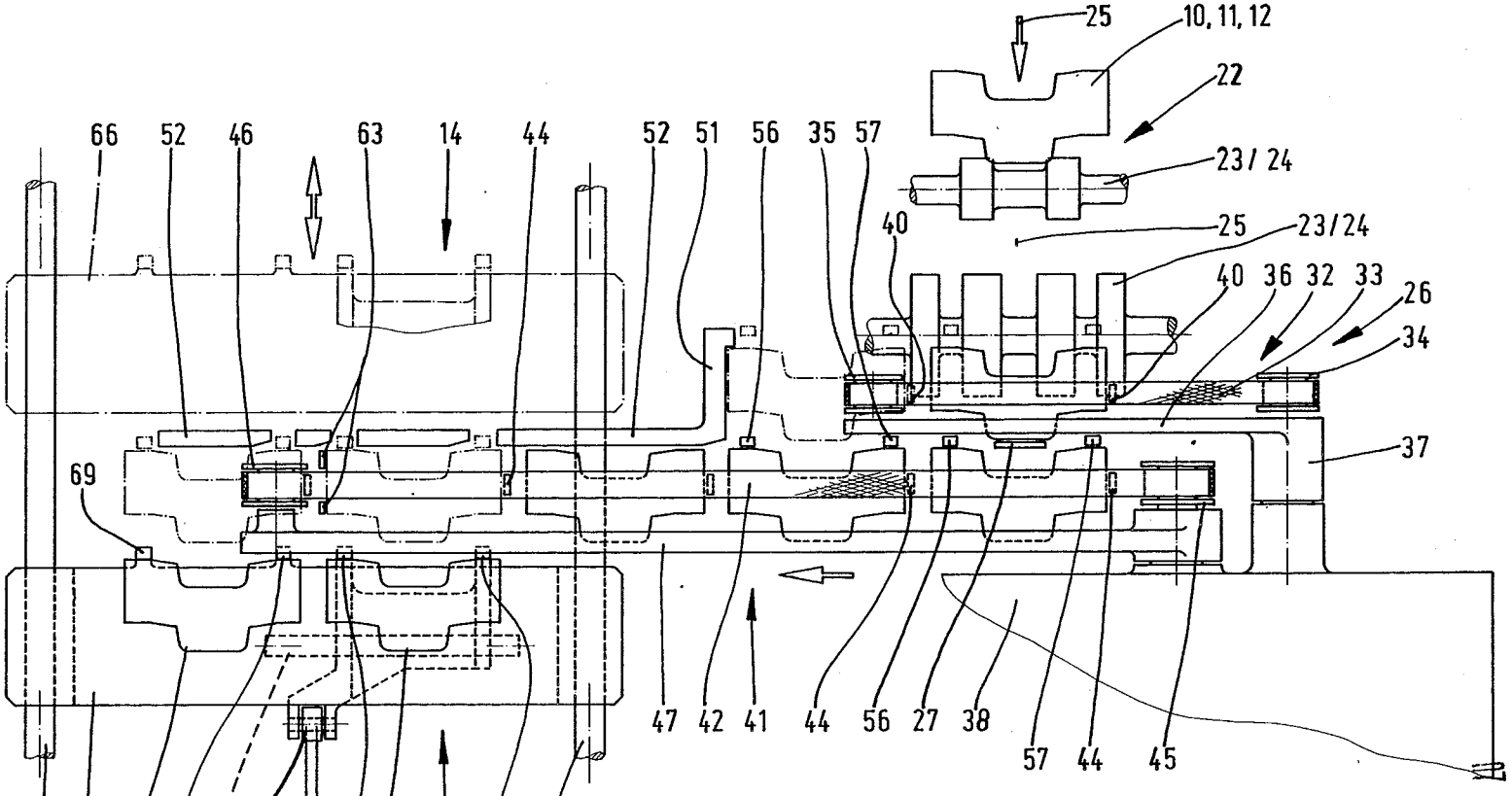
FIG. 3 shows a plan view of details of the apparatus, in particular conveying members for collar blanks.

In the region of the transfer station 14, two stops are necessary for the two collar blanks 10, 11 to be aligned with the cigarette blocks 15, 16. The collar blank 11 leading in the transport direction comes to rest against an end stop 62 of the feed track 31 (part of the supporting track 48). For the preceding collar blank 10 a movable intermediate stop 63 is provided. This is mounted pivotably above the feed track 31 on a pivoting plate 64 which is actuated by means of a connecting rod 65, in such a way that the intermediate stop 63 can be moved out of the path of movement of the collar blanks 10, 11 in the anti-clockwise direction (FIG. 4). As is evident from FIG. 3, the intermediate stop 63 is fork-shaped and thus acts outside the range of movement of the toothed belt 42.

The transfer of the aligned collar blanks 10, 11 to the cigarette blocks 15, 16 takes place in conjunction with a block platform 66 movable to and fro. The cigarette blocks 15, 16 rest temporarily on this before they are transferred to another conveyor (not shown). The block platform 66 is mounted laterally slideably on supporting rods 67, 68. The block platform 66 together with the cigarette blocks 15, 16 is moved underneath the collar blanks 10, 11 in the region of the feed track 31.

Arranged on the block platform 66 are vertical driving webs 69, 70; 71, 72 hook-shaped on the rear side, specifically two drivers 69, 70 and 71, 72 for each collar blank 10, 11. During the forward movement of the block platform 66, the drivers 69, 70, etc. are moved through the plane of the feed track 31, at the same time taking up the two collar blanks 10, 11. For this purpose, the supporting track 48 is interrupted in the region of the drivers 69, 70, etc. The collar blanks 10, 11 are accelerated by means of the drivers 69, 70, etc. to the speed of movement of the cigarette blocks 15, 16 on the block platform 66. As soon as the collar blanks 10, 11 leave the supporting track 48, they lay themselves automatically and in the correct position onto the top side of the cigarette blocks 15, 16.

Figure 7:
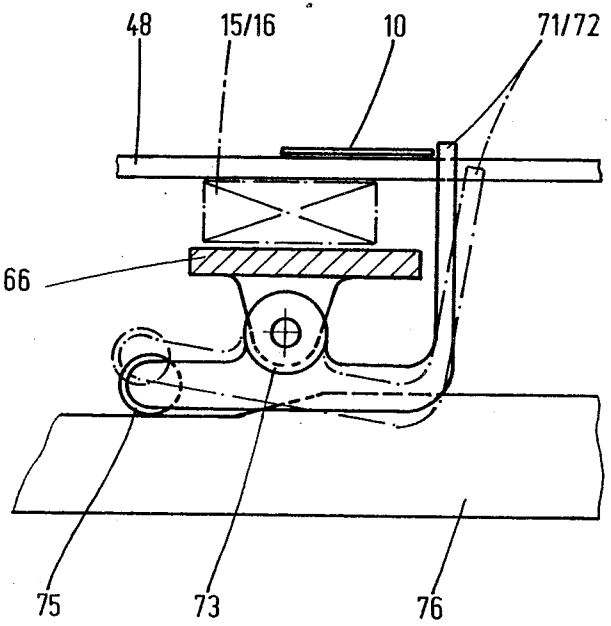
FIG. 7 shows a detail of the apparatus in the region of the transfer station partially in section and on a further-enlarged scale.

So that the subsequent conveyance of collar blanks 10, 11 into the transfer station 14 during the return of the block platform 66 into the initial position (represented by dot-and-dash lines in FIG. 3) is not impaired by the drivers 71, 72, these can be moved out of the plane of movement of the collar blanks 10, 11. For this purpose, the two drivers 71, 72 are mounted on a supporting sleeve 73 which is mounted pivotably on a supporting shaft 74 underneath the block platform 66. The supporting sleeve 73 is mounted rotatably on the supporting shaft 74 connected to the block platform 66. A tracer roller 75 is connected to the supporting sleeve 73 and runs on a rectilinear curved rail 76 of fixed location. The design of the curved rail 76 is selected so that the tracer roller 75 mounted at a distance from the supporting shaft 74 causes a rotational movement of the supporting sleeve 73 and consequently a pivoting movement of the drivers 71, 72, specifically out of the driving position represented by unbroken lines in FIG. 7 into a position, represented by dot-and-dash lines, underneath the plane of movement of the collar blanks.

What is claimed is:

1. Process for the production of hinge-lid packs having a collar, especially for cigarettes, collar blanks being severed from a material web and being laid individually onto a cigarette block to be introduced into the hinge-lid pack, said process comprising simultaneously producing two hinge-lid packs at a time in two production tracks extending next to one another, simultaneously feeding two collar banks (10, 11, 12) to a cigarette block (15, 16) and severing them successively from a single common material web (13), moving the first of said two collar blanks (10, 11) as a result of a transverse shift into a position next to the other collar blank (11) to be processed simultaneously, and thereafter feeding the two collar blanks (10, 11) lying next to one another to associated cigarette blocks (15, 16) of the two production tracks (17, 18).

2. Process according to claim 1, further comprising conveying the collar blanks (10, 11, 12) severed successively from the common material web (13) along a blank track (25) into an intermediate station (26), moving a first of the two simultaneously processed collar blanks (10, 11) as a result of a transverse shift into a sideways position offset relative to the blank track (25) while maintaining the second collar blank (11) in said intermediate station (26) in the blank track (25), and thereafter simultaneously conveying the two collar blanks (10, 11) further out of the intermediate station (26).

3. Process according to claim 2, further comprising moving the two collar blanks (10, 11) lying next to one another out of the intermediate station (26) into a feed track (31) and conveying them transversely relative to the blank track (25) to a transfer station (14) for transfer to the cigarette blocks (15, 16).

4. Process according to claim 3, further comprising, in the region of the feed track (31), simultaneously further conveying three collar blanks (10, 11, 12) at a time, during a conveying stroke, by the amount of a transport travel corresponding to two collar blanks (10, 11, 12) lying next to one another, so that two collar blanks (10, 11) pass into the transfer station (14) during each conveying stroke.

5. Apparatus for the production of hinge-lid packs having a collar, especially for cigarettes, in which collar blanks are severed from a material web and laid individually onto a cigarette block to be introduced into the hinge-lid pack, said apparatus comprising: blank conveyor means (22) for feeding the severed collar blanks (10, 11, 12) successively to an intermediate station (26); cross conveyor means (32) for moving a first of two collar blanks (10, 11), which are fed simultaneously to a cigarette block (15, 16), into a sideways position next to the blank conveyor means (22); and means for transporting the first collar blank (10) further out of the sideways position, together with a following collar blank (11), in the direction of the blank conveyor means (22).

6. Apparatus according to claim 5, wherein for the transport of a collar blank (10) into a sideways position, said cross conveyor means (32) comprises a toothed belt (33) which is directed transversely relative to the blank conveyor means (22) and of which a lower strand, as a conveying strand (39), is equipped with drivers (40), arranged at a distance from one another, for grasping a collar blank (10) at a side edge thereof.

7. Apparatus according to claim 6, wherein distances between the drivers (40) of the toothed belt (33) and a movement stroke thereof are coordinated with one another in such a way that the collar blank (10) is transported only during a part conveying stroke of 110 millimetres with a preceding idle stroke of 70 millimetres.

8. Apparatus according to claim 5, further comprising transfer conveyor means (54) for feeding the two collar blanks (10, 11) lying next to one another from the intermediate station (26) to feed conveyor means (41) which transports the blanks into a transfer station (14) intermittently in the transverse direction.

9. Apparatus according to claim 8, wherein the transfer conveyor means (54) comprises a gathering arm (55) common to the two collar blanks (10, 11) and having two pairs of driving fingers (56, 57), each for grasping a collar blank (10, 11) on its rear side, and a crank mechanism for moving the gathering arm (55) for the transport of the collar blanks (10, 11) in such a way that the driving fingers (56, 57) return to an initial position underneath a path of movement to the collar blanks (10, 11).

10. Apparatus according to claim 8, wherein the feed conveyor means (41) comprises a toothed belt (42), with a lower strand as a conveying strand (43) and with drivers (44), the distance between which corresponds to the distance between the collar blanks (10, 11) in the transfer station (14) and the number of which is that necessary for the simultaneous transport of three collar blanks (10, 11, 12).

11. Apparatus according to claim 5, further comprising stop means (27), located in the transport region of said blank conveyor means (22), for determining a position of the arriving collar blanks (10, 11) in the intermediate station (26), and, for further transport of the collar blanks (10, 11), said stop means (27) being lowerable downwards out of a path of movement of the collar blanks.

12. Apparatus according to claim 8, further comprising stop means (62, 63) for determining an end position of the two collar blanks (10, 11) in the transfer station (14), wherein said stop means (62, 63) are assigned to each collar blank (10, 11) and include an intermediate stop (63) assigned to the second collar blank (10), and means for periodically moving said intermediate stop (63) out of a path of movement of the collar blanks.

13. Apparatus according to claim 8, further comprising block platform means (66), movable to and fro, for periodically conveying cigarette blocks (15, 16) in the region of the transfer station (14), and wherein the block platform means (66) is equipped with pairs of drivers (69, 70; 71, 72) for grasping a respective collar blank (10, 11) on a rear side thereof.

14. Apparatus according to claim 13, wherein the drivers (71, 72) are assigned to the second collar blank (10) in the region of the transfer station (14) and, for a return movement, are lowerable downwards into an initial position underneath a conveying plane of the collar blanks (10, 11).

* * * * *